United States Patent [19]

Harvey et al.

[11] Patent Number: 4,595,824

[45] Date of Patent: Jun. 17, 1986

[54] HEATER BLOCK ASSEMBLY FOR USE IN THERMAL OXIDATION TESTING OF JET FUEL

[75] Inventors: Robert A. Harvey, Cheyenne, Wyo.; Robert W. Morris, Jr., West Liberty, Ohio

[73] Assignee: The United States of America as represented by the Secretary of the Air Force, Washington, D.C.

[21] Appl. No.: 651,983

[22] Filed: Sep. 19, 1984

[51] Int. Cl.[4] ..... H05B 1/02; F24H 1/10

[52] U.S. Cl. ..... 219/302; 219/299; 219/305; 219/308; 374/43; 374/45

[58] Field of Search ..... 219/296–299, 219/301–305, 308; 374/43, 44, 45

[56] References Cited

U.S. PATENT DOCUMENTS

| | | | |
|---|---|---|---|
| 1,654,551 | 1/1928 | Muhleisen | 219/301 |
| 2,833,909 | 5/1958 | Levey | 219/302 X |
| 2,834,468 | 5/1958 | Thomas et al. | 219/302 X |
| 3,782,456 | 1/1974 | Gusmer | 219/301 X |
| 4,292,837 | 10/1981 | Oakman . | |
| 4,508,957 | 4/1985 | Rocchitelli | 219/296 X |

OTHER PUBLICATIONS

"Proposed ASTM Method of Test for Thermal Oxidation Stability of Turbin Fuels Utilizing Jet Fuel Thermal Oxidation Tester", ALCOR Inc., San Antonio, Texas 78238, Aug. 1972.

*Primary Examiner*—A. Bartis

*Attorney, Agent, or Firm*—Donald J. Singer; John R. Flanagan; Bobby D. Scearce

[57] ABSTRACT

A heater block assembly for a jet fuel thermal oxidation test apparatus has back and front plates with a test plate clamped therebetween. The test plate has a flat surface which faces the front plate, while the front plate has a raised ledge with a channel formed therein which faces the flat surface of the test plate. Also, inlet and outlet openings to opposite ends of the channel are formed through the front plate. When the back and front plates are clamped together with the test plate therebetween, the flat surface of the test plate and the channel in the front plate together define a fuel sample flow passage. Thus, the fuel sample undergoing test is pumped through the inlet on the front plate into the flow passage where it flows along and in contact with the flat surface and then out through the outlet on the front plate. Electric heating rods disposed in the back plate raise the temperature of the back plate and thereby the test plate and fuel sample, causing thermal decomposition deposits from the heated fuel to form on the flat surface of the test plate.

3 Claims, 5 Drawing Figures

HEATER BLOCK ASSEMBLY FOR USE IN THERMAL OXIDATION TESTING OF JET FUEL

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention broadly relates to thermal oxidation testing of jet fuel and, more particularly, is concerned with a heater block assembly which allows for fuel thermal degradation deposits to be formed on a flat surface during the testing.

2. Description of the Prior Art

A conventional method for measuring the high temperature stability of a gas turbine fuel subjects a test sample of the fuel to conditions which can be related to those occurring in gas turbine engine fuel systems. The fuel sample is pumped at a fixed volumetric flow rate through a heater after which it enters a precision stainless steel filter where fuel degradation products may become trapped. The heater contains a heated aluminum tube and the fuel sample flows along and in contact with the exterior of the heated tube during the test.

The essential data derived from the test are the amount of thermal degradation deposits on the aluminum heater tube, and the rate of plugging of the precision filter located just downstream of the heater tube. The test results are indicative of fuel performance during gas turbine operation and can be used to assess the level of deposits that form when liquid fuel contacts a heated surface that is at a specified temperature. Further details of the testing method may be gained by reference to a publication designated as Report No. 72-162 and entitled "Proposed ASTM Method of Test for Thermal Oxidation Stability of Turbine Fuels Utilizing Jet Fuel Thermal Oxidation Tester" by ALCOR Inc., 5420 Bandera Road, San Antonio, Tex. 78238, dated August 1972.

One problem associated with the existing test apparatus is that the fuel deposits which will be analyzed are formed on an exterior surface of the heated tube which has a cylindrical shape. Procedures required to carryout certain analytical chemistry methods are difficult to perform on deposits present on rounded surfaces. For example, in infrared analysis of deposits one needs to look at a flat area or region of the deposit to perform the analysis.

Consequently, a need exists for improvement of the test apparatus so as to facilitate and accommodate the performance of a broader range of analytical chemistry methods on the deposits resulting from the test.

SUMMARY OF THE INVENTION

The present invention provides a heater block assembly designed to satisfy the aforementioned needs. The assembly employs a flat heated test plate in its fuel sample flow passage which allows fuel deposits to be formed on a flat surface. The test plate can then be removed from the test apparatus and analyzed by various analytical chemistry methods to determine structural features of the deposit. Also, the test plate is composed of soft aluminum material while the remainder of the assembly components are made of stainless steel.

The difference in malleability of these materials is utilized to form a seal around the fuel sample flow passage defined adjacent the test plate.

Accordingly, the present invention is directed to a heater block assembly for a jet fuel thermal oxidation test apparatus, which comprises the combination of: (a) a back plate; (b) a front plate; (c) a test plate disposed between the back and front plates and having a flat surface thereon; (d) means on the front plate defining a channel and an inlet to and outlet from the channel; (e) means for clamping the back and front plates together with the test plate therebetween so as to seal the test plate against the front plate and thereby define a fuel sample flow passage between the flat surface on the test plate and the channel on the front plate; and (f) means connected to the back plate for heating the same and the test plate therewith clamped between the back and front plates.

More particularly, the heating means is in the form of a pair of heating rods insertable into the back plate at laterally spaced positions such that a portion of the back plate extending between the heating rods, and the test plate which is disposed in contact with the heated portion, are heated so as to provide a substantially uniform temperature gradient across them. By varying the temperature of the heating rods, the level to which the back plate and thereby the test plate are heated can be varied during the test. The fuel sample undergoing testing is pumped through the inlet on the front plate into the flow passage where it flows along and in contact with the flat surface and then out through the outlet on the front plate. Also, a thermocouple element is mounted in the back plate so as to make contact with the test plate in order to monitor the temperature of the plate.

DETAILED DESCRIPTION OF THE INVENTION

Figure 1:
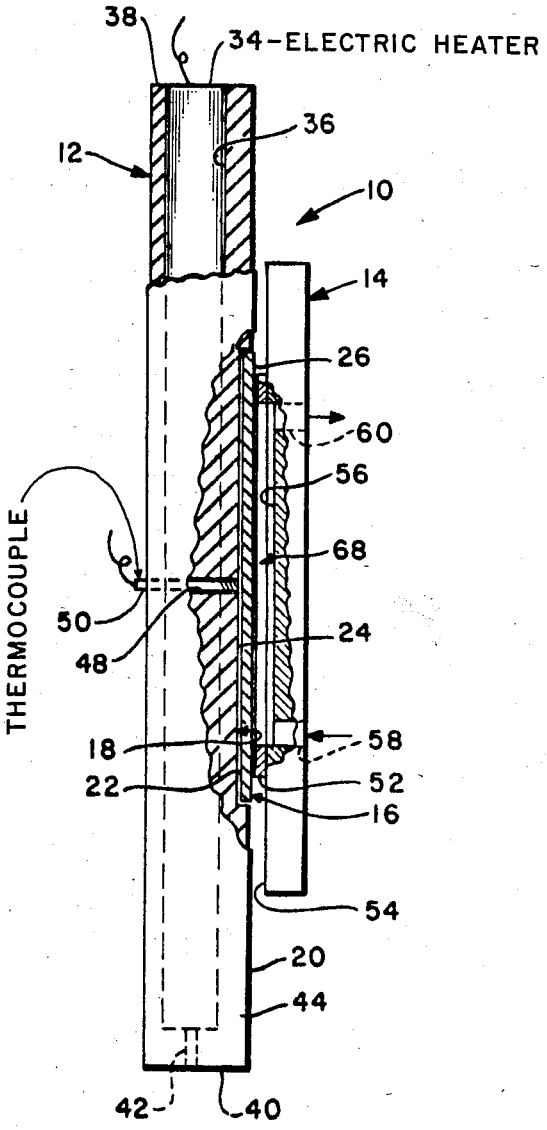
FIG. 1 is a side elevational view of the heater block assembly of the present invention, the assembly being illustrated partly in sectional form to show one of the heating elements and the fuel sample flow passage thereof.
Figure 4:
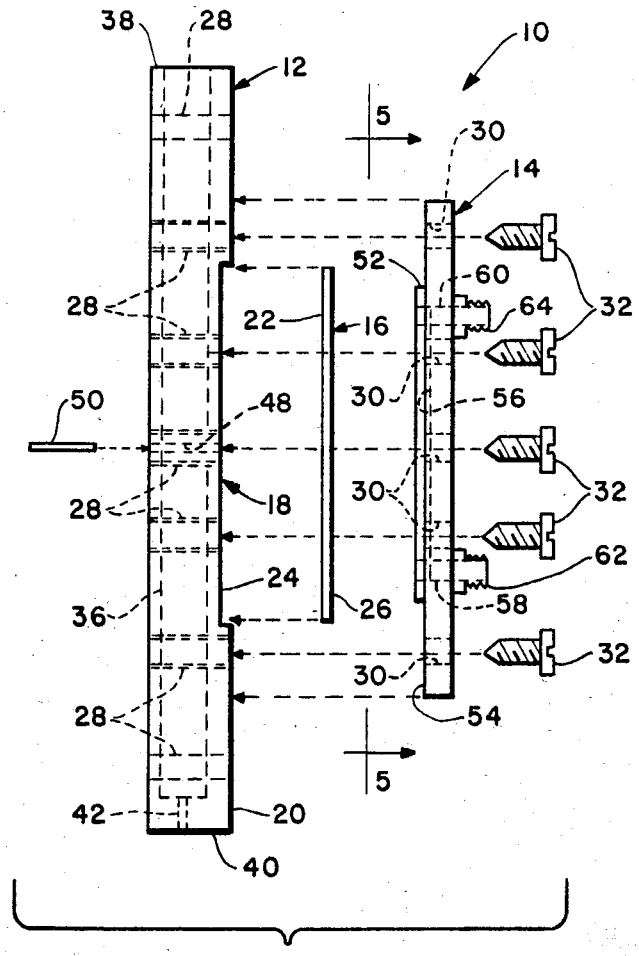
FIG. 4 is a side elevational view of the heater block assembly generally depicted in FIG. 1, but with the parts thereof illustrated in exploded form.

Referring now to the drawings, and more particularly to FIGS. 1 and 4, there is shown the preferred embodiment of the heater block assembly of the present invention, being generally designated 10. The assembly 10 is shown in assembled form in FIG. 1 minus means clamping its parts together and is shown in exploded, disassembled form in FIG. 4. The heater block assembly 10 basically includes a back plate 12, a front plate 14, and a flat heated test plate 16 disposed between the back and front plates 12,14. The back plate 12 has an undercut or recess 18 formed in the midsection of the front side 20 thereof which faces the front plate 14. The depth and height of the recess 18 are approximately equal to the thickness and height of plate 16. Therefore, as seen in FIG. 1, plate 16 can be accommodated in the recess 18 with its flat rear surface 22 flush with the bottom 24 of the recess 18 and its flat front surface 26 flush with the front side 20 of the back plate 12.

The assembly 10 also includes means in the form of first and second sets of holes 28,30 and a set of bolts 32 for clamping the back and front plates 12,14 together with plate 16 therebetween. The first set of holes 28 are defined through the back plate 12 in a pair of rows which are spaced apart at a distance slightly greater than the width of plate 16. The uppermost and lowermost pairs of holes 28 are drilled only, while the rest of the holes 28 are both drilled and tapped. The second set of holes 30 are defined through the front plate 14 in a pair of rows in which the respective positions of the holes 30 correspond to the positions of the holes 28 in the first set thereof as defined through the back plate 12. All of the holes 30 in the front plate 14 are drilled only. Therefore, when plate 16 is disposed as desired in the recess 18 between the rows of holes 28 of the back plate 12, the front plate 14 can be attached to the back plate 12 by inserting the bolts 32 through the holes 30 and then threadably screwing the bolts into the holes 28.

Figure 3:
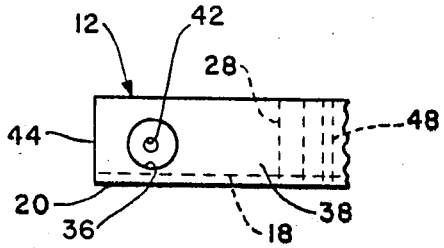
FIG. 3 is a fragmentary top plan view of the back plate as seen along line 3—3 in FIG. 2.
Figure 2:
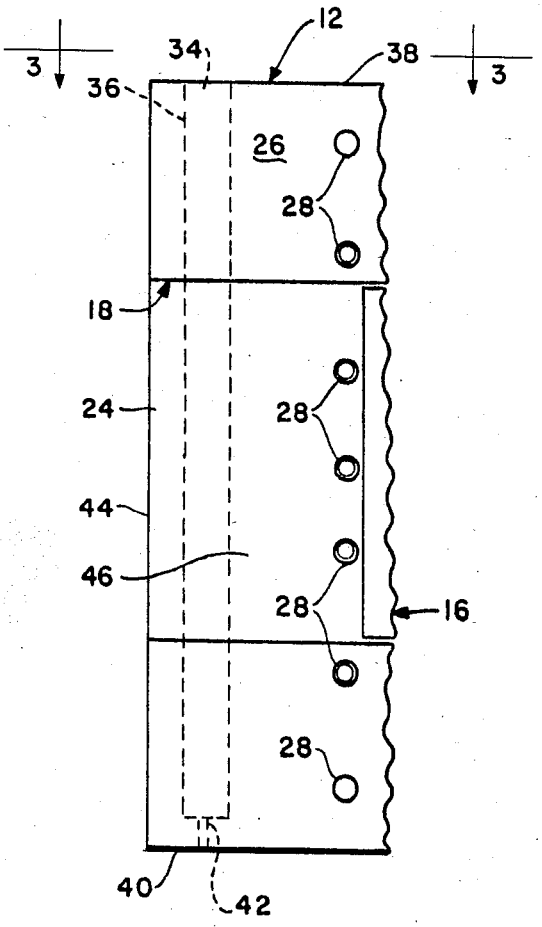
FIG. 2 is a fragmentary front elevational view of the back plate and heated test plate together, with approximately one-half of the plates being omitted for purposes of clarity.

The back plate 12 and flat plate 16 disposed within the recess 18 in the plate 12 are heated by means in the form of a pair of electric heating rods 34 incorporated in the heater block assembly 10. The heating rods 34 are received in elongated holes 36 formed in the back plate 12 so as to extend from the top end 38 thereof to just short of the bottom end 40 of the plate. Small diameter air holes 42 extend between the lower ends of the elongated holes 36 and the bottom end 40 of the plate 12. As depicted in FIGS. 2 and 3, each elongated hole 36 (only one of which is seen in these figures) is located between one of the rows of holes 28 and the side 44 of the plate 12, with the hole 36 being nearer to the side than to the row of holes. The portion 46 of the back plate 12 extending between the heating rods 34, and the flat plate 16 disposed within the recess 18 in contact with the back plate portion 46 are heated so as to have a substantially uniform temperature gradient formed across them.

A small diameter hole 48 is drilled through the center of the back plate 12 and receives a thermocouple element 50 for sensing the temperature of plate 16 during the operation of the prior art test apparatus (not shown) with which the assembly 10 can be used.

Figure 5:
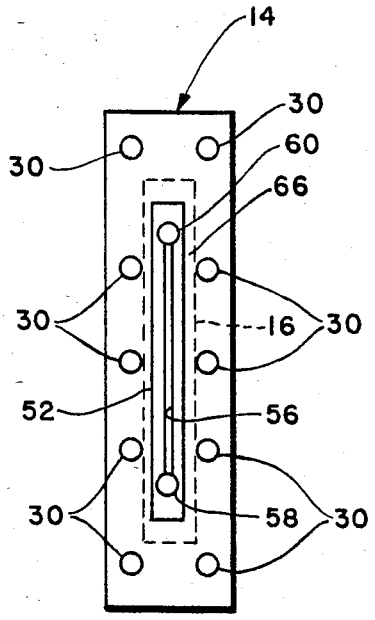
FIG. 5 is an back elevational view of the front plate as seen along line 5—5 in FIG. 4.

Finally, as seen in FIG. 5, the front plate 14 of the heater block assembly 10 has a rectangular-shaped raised ledge 52 on its rear side 54 which faces the front side 20 of the back plate 12. The ledge 52 is located between the rows of holes 30 through the front plate 14 and has a generally linearly-extending groove or channel 56 formed centrally therein, which channel also extends a short depth into the rear side 54 of the front plate 14. A pair of holes 58,60 are drilled through the front plate 14 at opposite ends of the channel 56 so as to intersect with the channel. These holes 58,60 are tapped to adapt them to threadably receive a pair of fittings 62,64 and thereby provide an inlet to and outlet from the channel 56.

When the back plate 12 and front plate 14 are assembled together with plate 16 disposed and clamped therebetween, such as seen in FIG. 1, the raised ledge 52 is compressed against plate 16. Specifically, the portion 66 of the ledge 52 extending between the channel 56 and the rows of holes 30 and which overlaps plate 16 (shown in broken outline form in FIG. 5) seals against the front flat surface 26 of the plate 16 and defines a fuel sample flow passage 68 therewith.

As seen in FIG. 1, the fuel sample which is to undergo testing will be pumped through the inlet hole 58 on the front plate 14 into the flow passage 68 where it flows along and in contact with the flat surface 26 of plate 16 and then out through the outlet hole 60 on the front plate 14. By varying the temperature of the heating rods 34, the level to which the back plate 12 and thereby plate 16 are heated can be varied during the test. The temperature of the fuel is also increased causing any thermal decomposition deposits from the heated fuel to form on the flat surface 26 of plate 16. The thermocouple element 50 is used to monitor the temperature of plate 16.

In an exemplary embodiment, the back and front plates 12,14 are made of 316 stainless steel and plate 16 is made of soft aluminum (e.g. 6061 aluminum). The difference in malleability of these materials is utilized to form the seal around the fuel sample flow passage 68 when the plates are clamped together.

It is thought that the heater block assembly 10 of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. A heater block assembly for use in a jet fuel thermal oxidation test apparatus, comprising:

a. a back plate;

b. a front plate;

c. a test plate disposed between said back and front plates and having a flat surface defined thereon;

d. means on the rear face of said front plate defining a rearwardly facing channel, and means defining an inlet to and an outlet from said channel;

e. means for clamping said back and front plates together with said test plate therebetween so as to seal said test plate against the rear face of said front plate thereby covering said channel to define a fuel sample flow passage between said flat surface on said test plate and said channel on said front plate; and f. means connected to said back plate for heating the same and said test plate therewith clamped between said back and front plates, said heating means being in the form of a pair of heating rods inserted into said back plate at laterally spaced locations such that a portion of said back plate extending between said rods, and said test plate disposed in contact with said back plate portion, are heated so as to have a substantially uniform temperature gradient across them.

2. A heater block assembly for use in a jet fuel thermal oxidation test apparatus, comprising:

a. a back plate;

b. a front plate;

c. a test plate disposed between said back and front plates and having a flat surface defined thereon;

d. means on the rear face of said front plate defining a rearwardly facing channel, and means defining an inlet to and an outlet from said channel;

e. means for clamping said back and front plates together with said test plate therebetween so as to seal said test plate against the rear face of said front plate thereby covering said channel to define a fuel sample flow passage between said flat surface on said test plate and said channel on said front plate;

f. means connected to said back plate for heating the same and said test plate therewith clamped between said back and front plates; and g. a thermocouple element mounted in said back plate so as to make contact with said test plate.

3. A heater block assembly for use in a jet fuel thermal oxidation test apparatus, comprising:

a. a back plate;

b. a front plate;

c. means on the rear face of said front plate defining a rearwardly facing channel, and means defining an inlet to and an outlet from said channel;

d. a test plate disposed between said back and front plates and having a flat surface defined thereon;

e. means for clamping said back and front plates together with said test plate therebetween so as to seal said test plate against the rear face of said front plate and thereby covering said channel to define a fuel sample flow passage between said flat surface on said test plate and said channel on said front plate, said test plate being formed of soft aluminum material and said back and front plates being formed of stainless steel material, whereby the difference in malleability of said materials provides the seal around said fuel sample flow passage when said back and front plates are clamped together; and f. means connected to said back plate for heating the same and said test plate therewith clamped between said back and front plates.

* * * * *